US005832581A

United States Patent [19]

Barthuli

[11] Patent Number: 5,832,581

[45] Date of Patent: Nov. 10, 1998

[54] DIESEL ENGINE FORK LIFTING TOOL

[76] Inventor: Rick Samuel Barthuli, 1335 Lodge Cr., Spring Hill, Fla. 34606

[21] Appl. No.: 645,718

[22] Filed: May 14, 1996

[51] Int. Cl.[6] ..... B66F 3/00

[52] U.S. Cl. ..... 29/267; 254/131

[58] Field of Search ..... 254/120, 131, 254/1, 129, 130, 131.5, 133 R, DIG. 3, 7 B, 8 B, 17, 102; 29/244, 267

[56] References Cited

U.S. PATENT DOCUMENTS

| | | | |
|---|---|---|---|
| 12,464 | 2/1855 | Ball | 254/102 |
| 459,769 | 9/1891 | Russell | 254/102 |
| 811,116 | 1/1906 | Adams | 254/129 |
| 1,093,405 | 4/1914 | Hallen | 254/130 |
| 1,307,600 | 6/1919 | Rose et al. | 254/8 B |
| 1,781,833 | 11/1930 | Cummer | 254/17 |
| 1,826,110 | 10/1931 | Wickman | 254/7 B |
| 3,070,877 | 1/1963 | Schumann | 29/267 |
| 3,798,738 | 3/1974 | Purtell | 29/267 |
| 5,251,875 | 10/1993 | Craychee et al. | 254/133 R |

FOREIGN PATENT DOCUMENTS

| | | | |
|---|---|---|---|
| 1275817 | 10/1961 | France | 254/131 |

*Primary Examiner*—Robert C. Watson
*Attorney, Agent, or Firm*—Douglas S. Bishop

[57] ABSTRACT

A tool for lifting the fork rod of a diesel engine for ready replacement of a fork blade. The lifting tool includes a base having an upper arcuate edge for engagement with a maintenance manhole of the diesel engine. A fulcrum plate projects from the base and has a bore formed therethrough. A two-shafted lifting arm has a complementary bore for pivotal movement with respect to the base by insertion of a fulcrum shaft through the aligned bores. A handle is insertable into one of the shafts, and a fork into the other. The fork includes a fork head having a pair of spaced apart tongs including means for engagement with the fork rod. By depressing the handle, the fork arm may be pivoted into a raised position, thus lifting the fork rod when it is engaged with the tongs. Means are also provided for fixing the fork head into the raised position.

5 Claims, 3 Drawing Sheets

DIESEL ENGINE FORK LIFTING TOOL

FIELD OF THE INVENTION

This invention relates to the field of diesel engine maintenance tools and, more particularly, to a tool for lifting the fork rod of a diesel engine for ready replacement of rod assembly components.

BACKGROUND OF THE INVENTION

Large diesel engines, such as the EMD '567, 645 and 710 series marine diesel engines, because of their size and complexity, present somewhat of a challenge in terms of normal maintenance. Occasionally, in the course of normal maintenance of such diesel engines, it is necessary to replace the power pack assemblies. Furthermore, one or more of the components may become damaged or worn out, thus necessitating replacement.

The EMD style rod bearing assembly 7 (FIG. 1) is unique in that both left and right bank connecting rods are centered on their respective rod journals. Thus, they display the "trunnion type" interlocking blade and fork construction. The blade rod 1 moves back and forth on the back of the upper connecting rod bearing 2, and is held in place by a counter bore and the fork rod 3. One end of the blade rod slipper foot is longer than the other and is known as the long toe 5. Blade rods 1 are installed with the long toe 5 toward the center of the engine. Fork rods 3 and baskets 2 are not interchangeable since they are line-bored as an assembly, and both fork rod and basket are stamped with an identical assembly serial number. This configuration creates some unusual problems in their replacement.

In order to remove the blade style pack, the piston 5 on the fork pack 3 must be raised to give the blade 1 clearance for removal. This may be accomplished by lifting the fork piston 5 with a piston holding tool (standard part number EMD P/N 8417859) (FIG. 2) through the fuel injector hole, after first removing the rocker assembly, fuel jumper, rack lineage, and injector. Alternatively, the fork pack may be raised by using a rod support tool (standard part number EMD P/N 8052958) (FIG. 3) if the engine may be jacked in either direction.

With regard to the first method, the man hours required to strip the top deck on the fork side, and subsequently reassemble it, re-torque, and readjust the valve lash, injector timing, and rack setting is very considerable.

With regard to the second method, it is very difficult to jack the engine in either direction. This presents a considerable safety risk when rolling the engine, with the possibility of the repair technician's hands being caught in the engine.

Thus, there is a need for a simple, efficient, and relatively inexpensive device which presents neither of these problems, and is safer to use.

There is also a need for a fork lifting tool which can be used on blade pack assemblies having both right and left hand long toes.

SUMMARY OF THE INVENTION

Disclosed and claimed herein is a fork lifting tool developed and constructed to expedite the replacement of blade style power pack assemblies in the EMD series of diesel engines. It includes an adjustable lifting arm which is engageable with the fork rod, and lifts the fork rod when the lifting arm is pivoted on a base set into the manhole frame of the engine.

The lifting tool includes a base having an arcuate top edge for engagement with a maintenance manhole of the diesel engine. A fulcrum plate with a bore formed therethrough extends up from the base. Preferably, it is disposed near one end of the arcuate top edge. Thus, by turning the base around, the lifting arm may be alignable with either right or left hand rod bearing assemblies.

The lifting tool further includes a two-shafted lifting arm which is attached to said fulcrum plate. Preferably, the lifting arm also has a bore formed therethrough which is alignable with the fulcrum plate bore. A pivot shaft is insertable into the aligned bores so that the lifting arm is pivotally movable about the fulcrum plate. Means are also provided in the form of a locking pin for fixing the position of the lifting arm with respect to the base.

Preferably, the two shafts of the lifting arm are disposed at an obtuse angle (approximately 100°) with respect to each other. A handle is insertable into either of the two shafts of the lifting arm. The handle is configured and dimensioned so that downward pressure on the lifting arm may be easily applied by the operator.

A fork is insertable into the other of the shafts of the lifting arm. Preferably, the fork and the handle are interchangeable so that the lifting tool may be conveniently used to work on either right or left handed rod bearing assemblies simply by reversing the base as described previously. The fork includes a fork head having a pair of spaced apart tongs. Each of said tongs includes means for engaging a standard marine diesel engine fork rod. The tongs are spaced apart such that bolts disposed therein are alignable with the bolt holes of the upper bearing basket bolts. Thus, the fork head is easily engageable with the upper bearing basket simply by engaging the bolts with the bearing basket bolt holes and tightening them.

Preferably, the lifting tool further includes means for adjusting the length of the fork. One embodiment of the adjusting means includes an adjusting wheel which is mountable on the shaft of the lifting arm carrying the fork. Preferably, the adjusting wheel is a hollow, threaded tube. By providing mating threads on the lifting arm shaft, and on the fork, the length of the fork may be adjusted by turning the adjusting wheel. For example, the shaft may have internal threads for engagement with external threads at one end of the adjusting wheel, and the adjusting wheel may be provided with internal threads at its other end for engagement with external threads on the fork.

After the base is engaged with the maintenance manhole, and the fork head engaged with the fork rod by aligning the basket bolt holes with the tong bolts (as previously described), the lifting tool may be pivoted from a first, retracted position, to a second, extended position by depressing the handle of the tool downwardly. This causes the fork and fork head to pivot upwardly, thereby causing the fork to raise and lift the fork rod for ready replacement of a blade rod or other component. The tool is then fixed in the extended position by use of the lock pin (which is inserted through an appropriate aperture formed in the base) so that the replacement may be completed. The fork rod may then be lowered by reversing this operation and removing the tong bolts from the basket bolt holes.

BRIEF DESCRIPTION OF THE DRAWINGS

The following detailed description may best be understood by reference to the following drawings, in which.

DETAILED DESCRIPTION OF THE PREFERRED EMBODIMENTS

Figure 4:
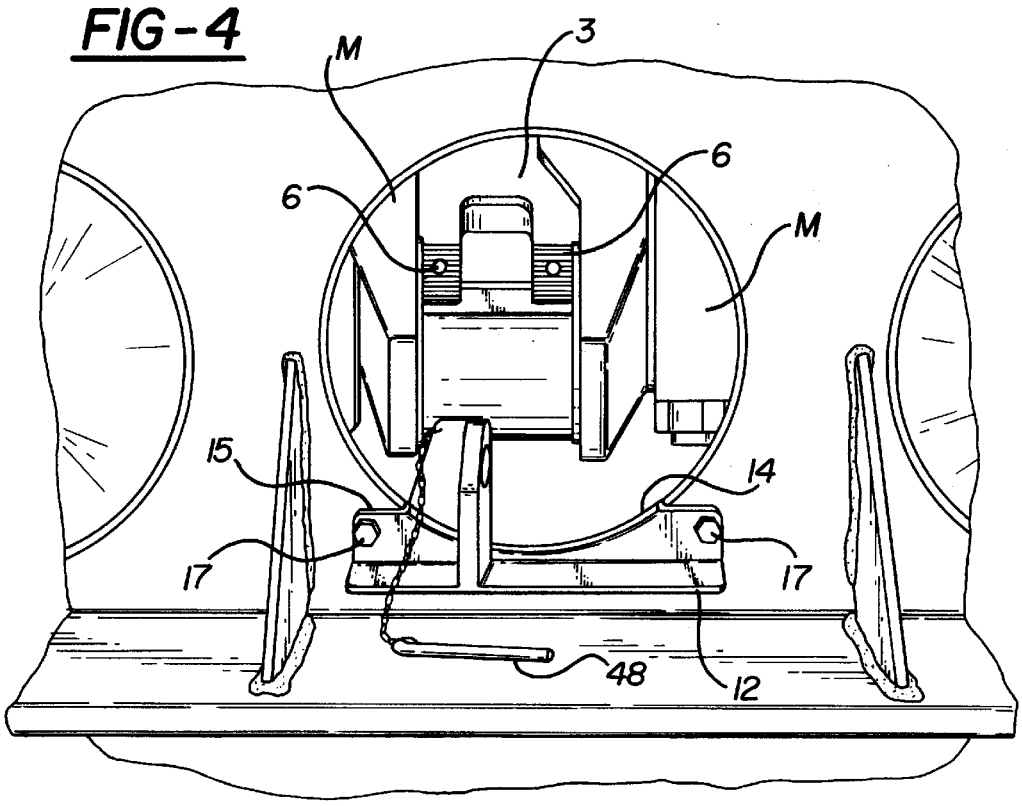
FIG. 4 is a perspective view of a maintenance manhole of an EMD 645 series diesel engine with the manhole cover removed, and the base of the lifting tool of the present invention in engagement therewith.
Figure 5:
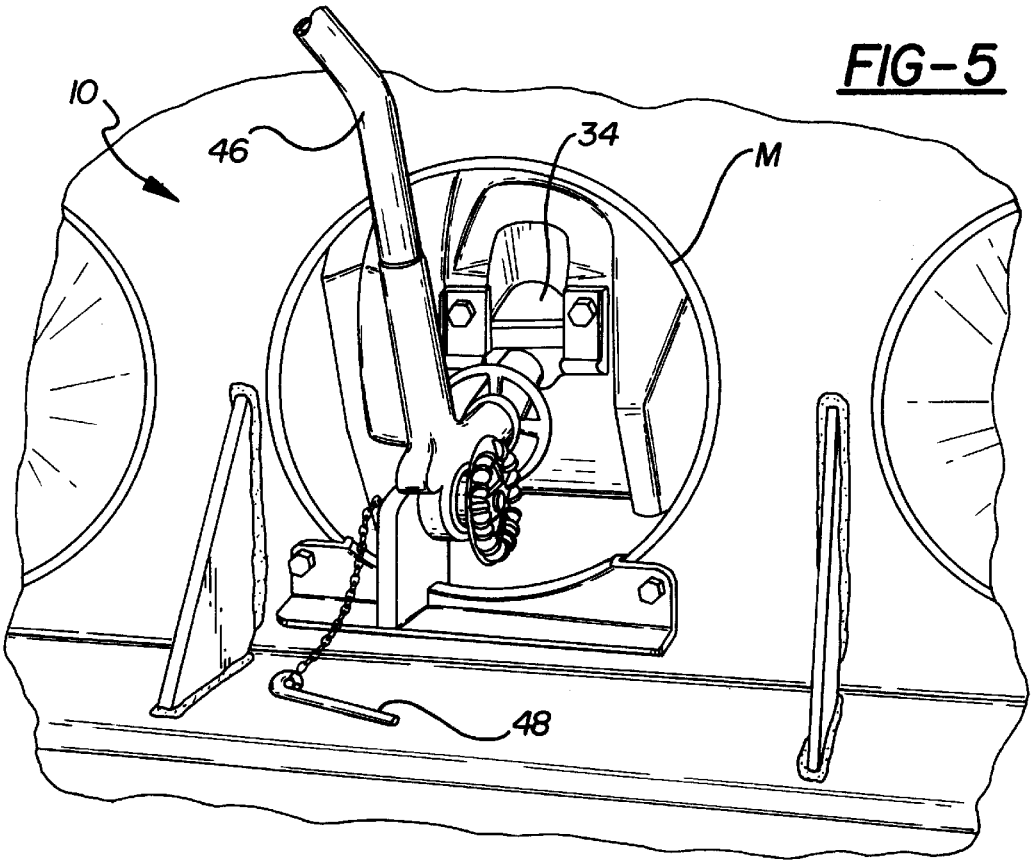
FIG. 5 is a view similar to FIG. 4 showing the fork lifter of the present invention assembled and installed for use.
Figure 6:
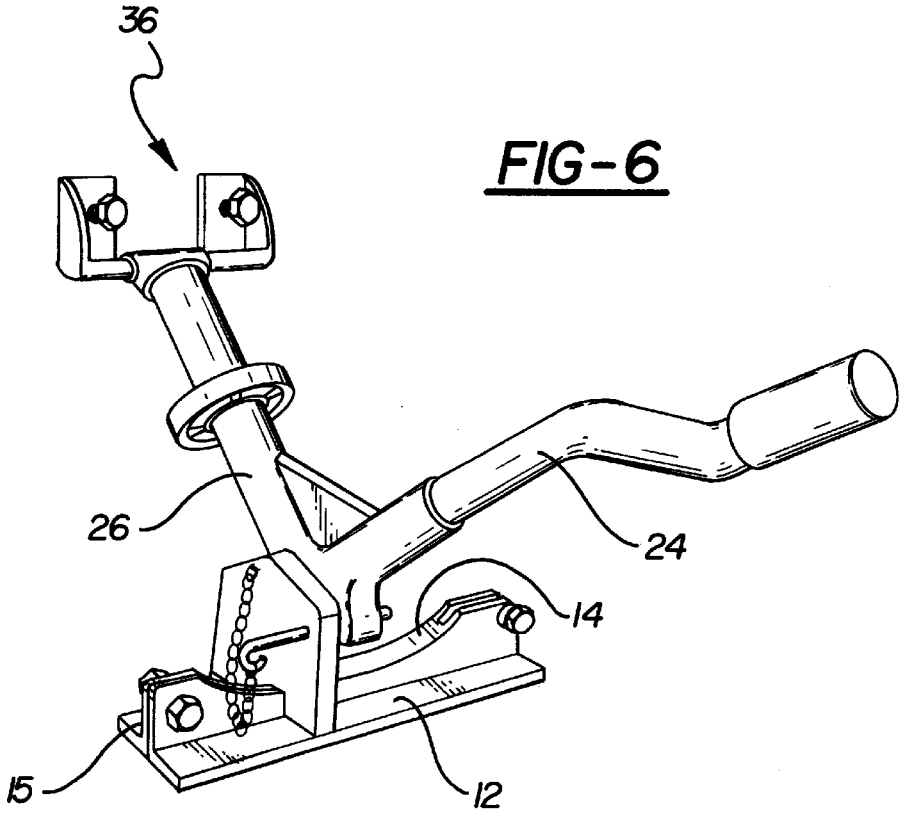
FIG. 6 is a perspective view of the lifting tool of the present invention.
Figure 7:
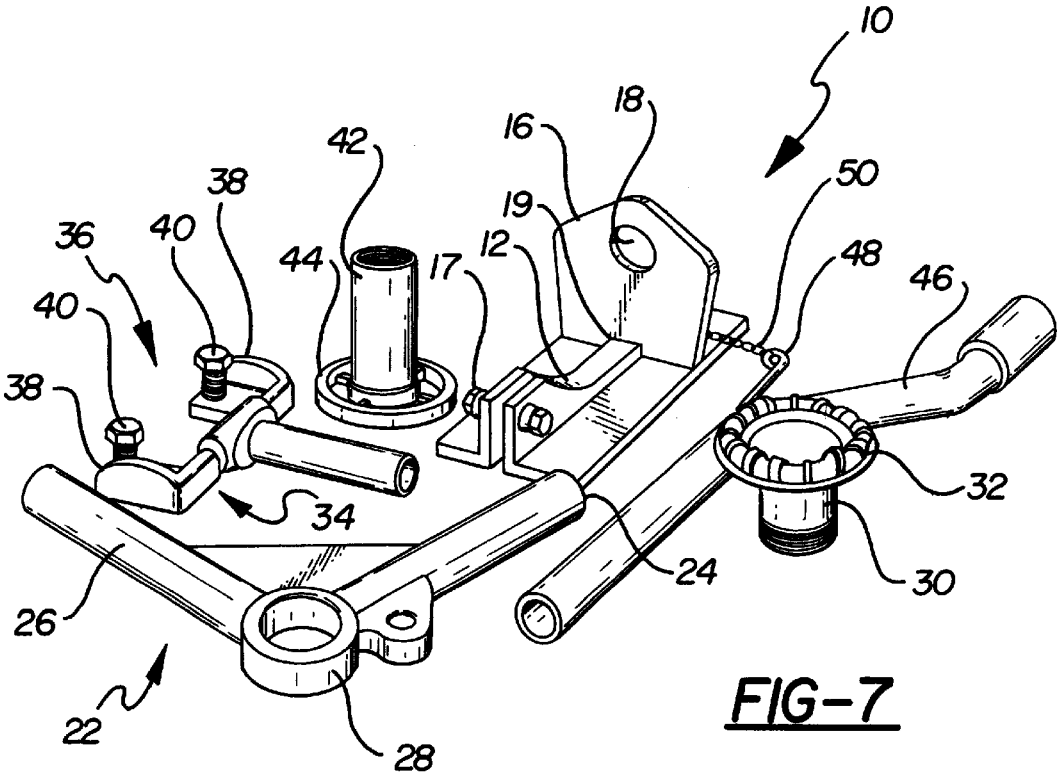
FIG. 7 is a perspective view of the lifting tool of FIG. 6 disassembled into its various parts.

Throughout the following detailed description, like numerals are used to reference the same elements of the herein invention shown on multiple figures thereof. Referring now to the drawings, and in particular to FIGS. 6 and 7, there is shown an embodiment of a fork lift tool 10 constructed in accordance with the teachings of the present invention. As can most clearly be seen in FIG. 7, which shows the fork lift tool 10 disassembled into its various components, the tool 10 includes a base 12 including an arcuate top edge 14. The arcuate top edge 14 is configured to engage the perimeter of the maintenance manhole M of a marine diesel engine (depicted in FIGS. 4 and 5). The base 12 is bolted onto the open manhole M by means of base bolts 17. FIG. 4 depicts a base 12 with its arcuate top edge 14 engaged with manhole M.

The base 12 further includes a fulcrum plate 16 which, in the depicted embodiment, extends vertically from the horizontal base 12. The fulcrum plate 16 includes a throughbore 18.

The fulcrum plate 16 is disposed proximate an end 15 of the arcuate top edge 14. As can be seen in FIGS. 4 and 5, this arrangement means that the fulcrum plate 16 and lifting arm 22 will be disposed proximate the end 15 of the arcuate top edge 14. For example, in the case of the embodiment depicted in FIGS. 4 and 5, the lifting arm 22 is disposed proximate the left end of the base and, thus, the lifting arm 22 lies closer to the left edge of the manhole M than to the right edge. This allows the lifting tool 10 to be aligned with the left hand fork assembly to which the manhole M of FIGS. 4 and 5 permits access.

The lifting tool 10 further includes a two-shafted lifting arm 22. The lifting arm 22 includes an arm bore 28 which is approximately the same diameter as the fulcrum bore 18. A pivot shaft 30 is insertable into the aligned bores 18, 28. Preferably, the pivot shaft 30 and bores 18, 28 are threaded. The pivot shaft 30 includes a pivot shaft head 32. By aligning the bores 18, 28 and threading the pivot shaft 30 therethrough, the lifting arm 22 may be installed onto the base 12, as has been done in FIG. 5. The lifting arm 22 is then disposed for pivotal movement with respect to the base 12.

The lifting arm 22 includes first and second hollow shafts 24, 26. In the depicted embodiment, the first and second shafts 24, 26 are disposed with respect to each other at an obtuse angle of approximately 100°. Preferably, the first and second shafts 24, 26 are identical in configuration.

Although not depicted, the tool 10 could just as easily be used with a right hand fork assembly by simply reversing the base 12 end-for-end so that the fulcrum plate 16 lies closer to the right hand end of the arcuate top edge 14. Since the first and second shafts 24, 26 are identical, the other components of the lifting tool 10 may be inserted into either of them as will subsequently be described.

Figure 1:
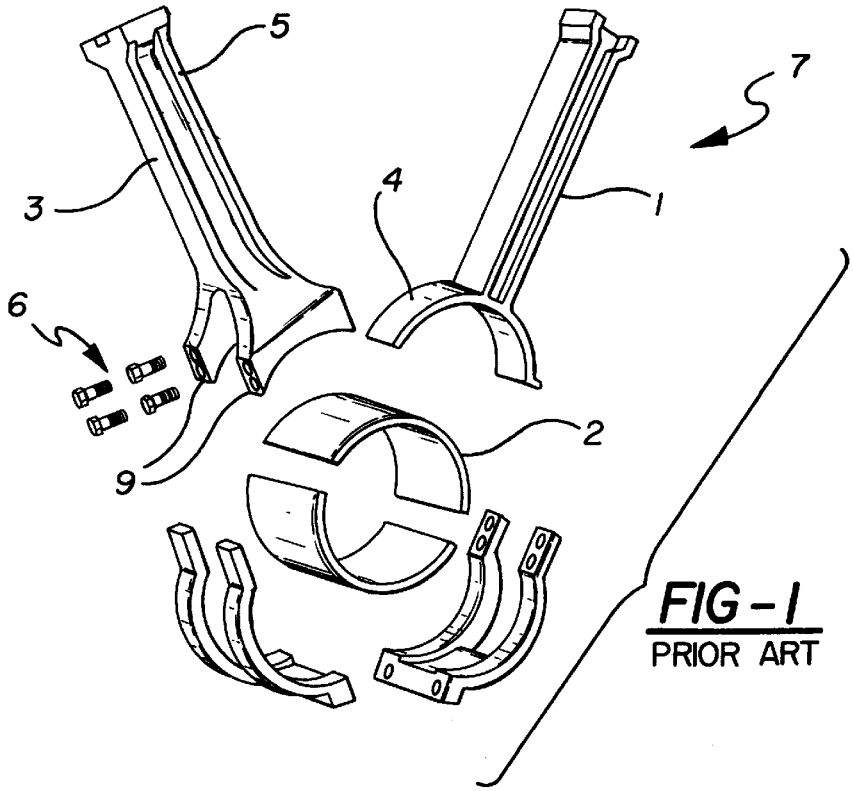
FIG-1 PRIOR ART
FIG. 1 is an exploded view of the connecting rods, bearing shells, and basket of a torque assembly of a 645 series diesel engine.
Figure 2:
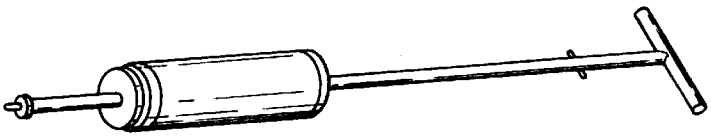
FIG-2 PRIOR ART
FIG. 2 is a perspective view of a prior art piston holding tool used to lift the fork of an EMD 645 series diesel engine.
Figure 3:
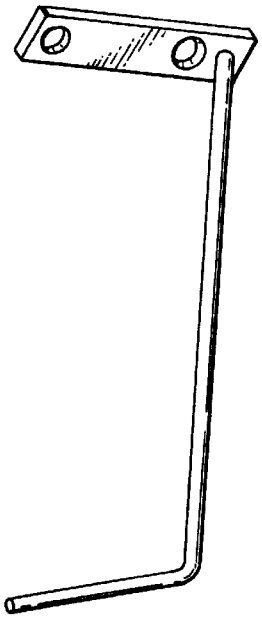
FIG-3 PRIOR ART
FIG. 3 is a perspective view of a prior art rod support tool used to roll the fork of an EMD 645 diesel engine off of the rod bearing.

A fork 34 is insertable into either of the first or second lifting arm shafts 24, 26. For example, in the assembled embodiment depicted in FIG. 6, the fork 34 is inserted into the second shaft 26 although it is to be understood that it could equally be inserted into the first shaft 24. The fork 34 includes a fork head 36. In the depicted embodiment, the fork head 36 is pivotally attached to the fork 34 so that the head 36 may be pivoted into a storage position (not depicted) although this feature is not considered essential to the practice of the present invention. Fork head 36 is provided with a pair of spaced apart tongs 38. Each tong 38 is provided with means 39 for engagement with the fork blade (3 of FIG. 1) of the fork assembly 7. The means 39 includes a bolt 40 disposed on each tong 38. The bolts 40 may be threaded through the bolt holes 9 of fork rod 3 of FIG. 1. FIG. 5 depicts the fork head 36 of the present invention with the tongs 38 engaged with the fork rod in this manner.

Tool 10 includes an adjusting wheel 42 which is provided with threads for engagement with one of the hollow shafts 24, 26 of lifting arm 22. The adjusting wheel 42 and the fork 34 are also threaded so that fork 34 may be inserted into adjusting wheel 42. Adjusting wheel 42 also includes an enlarged wheel head 44. By turning the wheel head 44 in either direction, the effective length of the fork 34 may be increased or decreased so that the tongs 38 may be brought into alignment with the fork rod 3, in the manner depicted in FIG. 5.

An elongated handle 46 is inserted into the other of the first and second shafts, 24, 26. In the depicted embodiment, the handle 46 is inserted into the first shaft 24, although, again, it is to be understood that it could be inserted into the second shaft 26 were it necessary to reverse a section of the tool 10 so that it could be equally used with a right handed fork assembly. The handle 46 is configured and dimensioned so as to provide a ready lever arm so that the fork 34 may be pivoted about the base 12 by lowering and raising the handle 46. Thus, the device may be pivoted from a first position, wherein the fork head is in a lowered position, to a second position wherein the fork head is in a raised position (FIG. 5). After the fork head is engaged with the blade assembly of the diesel engine, pivoting it into the second position by depressing the handle 46 will cause the fork rod 3 off of the rod bearing 2 for removal and replacement of the blade pack. After this is done, the fork 34 is lowered into the retracted position by simply raising the handle 46. The bolts 40 may then be removed from the bores 9, the base 12 unbolted from the manhole, the lifting tool 10 removed from the manhole, and the cover thereof replaced.

In order to fix the fork 34 into the second, raised position, a lock pin 48 is provided which is inserted into a bore 18 formed through the fulcrum plate. In the depicted embodiment, the lock pin 48 is attached to the base 12 by means of a chain 50 so that it will not become separated therefrom.

As can be seen from the disassembled view depicted in FIG. 7, the tool 10 of the present invention is very easy to assemble and disassemble into its component parts. Moreover, the parts are easy to manufacture from stock sheet and tubular steel. Thus, the tool 10 of the present invention may be readily manufactured. Moreover, it is simple to assemble and also to use. It provides a safe, convenient and quick way of lifting the fork packs of marine diesel engines so that routine maintenance or repairs may be readily performed thereon.

The present invention has been described with reference to certain embodiments and exemplifications thereof. It is to be understood that the fork lifting tool may be configured and designed somewhat differently from the depicted embodiments. For example, the means for engagement with the fork blade of the diesel engine may be designed somewhat differently from that depicted. Furthermore, the base could be configured somewhat differently from that depicted; for example, the entire fulcrum plate could pivot with respect to the base, thereby pivoting shafts affixed to the plate. However, such modifications of the present invention are considered to be within the skill of one knowledgeable in this art. Thus, it is the claims appended hereto, as well as reasonable equivalents thereof, rather than the exact depicted embodiments and exemplifications, which define the true scope of the present invention.

I claim:

1. A lifting tool for use with a diesel power pack comprising:

a base having an arcuate top edge for engagement with a maintenance manhole of a diesel engine, and a fulcrum plate with a bore formed therethrough disposed proximate one end of said arcuate edge;

a two-shafted lifting arm for attachment to said fulcrum plate and having a bore alienable with said fulcrum plate bore;

a pivot shaft insertable into said aligned fulcrum plate and lifting arm bores so that said lifting arm is pivotally rotatable about said fulcrum plate;

means for fixing the position of said lifting arm with respect to said base;

a handle insertable into one shaft of said lifting arm; and a fork insertable into the other shaft of said lifting arm, said fork including a fork head having spaced part tongs, each of said tongs having means formed thereon for engagement with a standard fork rod upper basket bolt hole, said tongs being spaced apart such that said means for engagement are alienable with the bolt holes of said upper basket bolt; and an adjustable wheel mountable in the other of said lifting arm shafts and linearly adjustable with respect thereto for adjusting the position of said fork head with respect to said base, wherein, when said fork is inserted into said diesel engine manhole and said tongs are engaged with said fork rod, said fork head may be pivoted from a first, retracted position to a second, extended position, thereby causing said fork head to raise and lift said fork rod for ready replacement of a fork blade.

2. The lifting tool of claim 1 wherein said two-shafted lifting arm comprises two hollow shafts extending from said lifting arm bore and orthogonal thereto said shafts being oriented so as to form an obtuse angle with respect to each other.

3. The lifting tool of claim 1 wherein said other of said shafts further comprises a threaded free end, and said adjusting wheel comprises a threaded, hollow tube for mating engagement therewith.

4. The lifting tool of claim 1 wherein each of said means for engagement comprises a bolt for insertion into said bolt hole.

5. The lifting tool of claim 1 wherein said fulcrum plate is disposed proximate an end of said arcuate top edge and said pivot shaft and wherein said fork and said handle are interchangeable.

* * * * *